US005188510A

United States Patent [19]

Norris et al.

[11] Patent Number: 5,188,510

[45] Date of Patent: Feb. 23, 1993

[54] METHOD AND APPARATUS FOR ENHANCING GAS TURBO MACHINERY FLOW

[75] Inventors: Thomas R. Norris, 15 Patricia Rd., Orinda, Calif. 94563; Hanford N. Lockwood, Jr., San Mateo; J. Alan Watts, Glendale, both of Calif.

[73] Assignee: Thomas R. Norris, Orinda, Calif. ; a part interest

[21] Appl. No.: 616,027

[22] Filed: Nov. 21, 1990

[51] Int. Cl.[5] ..... F01D 9/04

[52] U.S. Cl. ..... 415/208.1; 415/211.2

[58] Field of Search ..... 415/182.1, 208.1, 208.2, 415/211.2

[56] References Cited

U.S. PATENT DOCUMENTS

| | | | |
|---|---|---|---|
| 3,735,782 | 5/1973 | Strscheletzky | 415/182.1 |
| 4,540,338 | 9/1985 | Pukkila | 415/182.1 |
| 4,828,457 | 5/1989 | Bauer et al. | 415/182.1 |
| 4,969,421 | 11/1990 | Haner et al. | 415/208.1 |

FOREIGN PATENT DOCUMENTS

| | | | |
|---|---|---|---|
| 2231128 | 6/1972 | Fed. Rep. of Germany | 415/208.1 |
| 180823 | 6/1992 | United Kingdom | 415/182.1 |

OTHER PUBLICATIONS

GT35 Jupiter, The Industrial Gas Turbine for Power and Heat Production, Asea Stal, Jun. 4, 1989.

Diesel and Gas Turbine Worldwide, Sep. 1988, p. 6.

1989 International Gas Turbine and Aeroengine Technology Report, IGTI, Atlanta, GA, Sep. 1989, p. 81.

Gas Turbines for Power Generation, Alsthom, Sep. 1989, pp. 8–9.

*Primary Examiner*—John T. Kwon

*Attorney, Agent, or Firm*—Townsend and Townsend

[57] ABSTRACT

An improved efficiency flow enhancement method and system is provided for a duct system downstream of blading in a turbomachine, the system comprising the blading, a duct leading from the blading, two or more passages defined at least in part by partitions which take flow from within the duct, or from across its outlet, or from within four duct widths downstream of its outlet, the partitions defining at least partially separated flow passages intended for flows leaving the expanding duct of generally different mechanical energy, one or more zones of significant pressure drop for the flows of higher energy, one or more passages of comparatively less pressure drop for the passages with flows of lower mechanical energy, one or more zones where the flows are rejoined, and an outlet.

16 Claims, 13 Drawing Sheets

METHOD AND APPARATUS FOR ENHANCING GAS TURBO MACHINERY FLOW

BACKGROUND OF THE INVENTION

The invention relates to a method and device for producing an unusually efficient flow in those portions of turbo machines downstream of blading sections, with particular application to gas turbine and jet engine compressor outlets and turbine exhaust outlets.

Turbo machinery is becoming more widely applied to new and different applications as their performance improves with the utilization of new materials and better design analysis methods. For example, gas turbines and jet engines are becoming more powerful, more compact, and lighter, thereby having broader uses than ever before.

Turbo machinery efficiency depends on both achieving higher turbine inlet temperatures and on reducing various mechanical and flow losses. The flow losses are particularly large for flow in diverging sections of duct, which are found in most gas turbines and jet engines downstream of the compressor and downstream of the turbine. In these ducts, the flow is intended to expand in area and decelerate, exchanging kinetic energy for pressure energy. Typically, only 40 to 60 percent of the kinetic energy is recovered to become useful pressure energy. The remainder is converted either to heat, mostly by friction within the wall flow boundary layer, or exits the expanding area duct as unrecovered kinetic energy to become heat in a collector or receiver volume. However, the amount of area expansion practical, and therefore pressure recovery, is severely limited by flow separations or aerodynamic stalls that may develop if the expansion exceeds an area ratio of about 1.7 to 1, and will often develop at an area ratio of 2 to 1 unless the duct wall total divergence angle is kept small, usually below about 8 degrees. These small divergence angles mean that the expanding area duct will be long, however, and will not be compact or light. Even a tendency of momentary stalls or roughness, often of no concern if only efficiency is considered, will possibly result in more noise and vibration, an increase in compressor outlet pressure and a resultant possibility of aerodynamic stall of the compressor, which can be quite destructive. Accordingly, an expansion ratio of 2:1 or less is accepted practice for most turbo machines.

Because these blading outlet losses may total two percent of the compressor power input, or three percent of the turbine power output, these losses significantly affect fuel economy and power. In an industry where a performance difference of several percent in fuel economy is important, a 2 to 5 percent improvement is very significant, particularly for airline and electric power generation users who purchase enormous quantities of fuel.

Two specific examples of turbo machinery, a gas turbine exhaust outlet with both a divergent duct and a bend, and a divergent compressor outlet that may include a bend are discussed below.

Gas turbine engines are used in a variety of applications for the production of shaft power. In most gas turbine installations the turbine exhaust vents into an enclosure, often called a receiver or collector box, which is used to collect flow, then to direct the exhaust flow away from the axis of the turbine system. The typical gas turbine collector box is an enclosure which surrounds the outlet end of the turbine tailpipe and collects the exhaust gas to direct it away from the gas turbine tailpipe. Most often, the tailpipe is a divergent duct, such as a cone. Most collector boxes turn the exhaust gas 90 degrees from the gas turbine centerline, although exhaust paths from zero degrees to 160 degrees from the gas turbine centerline are used.

In small gas turbines, the collector box typically has a large width in relation to the diameter of the turbine last stage. The size of most collector boxes, however, does not increase proportionately with gas turbine capacity due to constraints such as maximum shipping dimensions, cost, or available installation space.

As the relative size of the collector box decreases with respect to the turbine outlet diameter, gas velocities in the collector box increase. Any turbulence in the collector box is therefore likely to cause large velocity differentials within the collector box as well as in the downstream ducts. These velocity differentials may induce destructive vibrations in the turbine, collector box or downstream ducts. The velocity differentials may also create steady or transient flow reversals or stalls in the exhaust gas flow which can increase vibrations levels, overall noise levels, and system back pressure. An increase in system back pressure will lower the turbine efficiency.

The turbine tailpipe typically protrudes into the collector box from the turbine outlet. The tailpipe may be either straight or divergent (usually conical and is often called a "tailcone". Because it maintains high exhaust gas velocities, the straight (non-expanding area) tailpipe design is less likely to experience stalls or flow reversals in the tailpipe. The straight design, however, maintains high back pressure which reduces the overall engine efficiency. The divergent tailpipe design slows the flow in a diffuser effect, exchanging kinetic energy for pressure, which improves engine performance. This exhaust for flow expansion, however, also increases the risk of aerodynamic stalls or flow pattern switching in the tailpipe which can cause destructive vibrations forces and noise.

There are two ways to extract output shaft power from a gas turbine. The first is route the power output shaft through the engine and out the compressor end. This design allows a clean collector box interior which contains only the exit of the tailpipe, but no shaft. The second design, which is found more often in industrial turbines, has the output shaft passing through the exhaust collector box. Depending on the power shaft coupling and turbine rear bearing cooling design, the power output shaft housing may be small or large in relation to the size of the collector box. In large gas turbines where the collector box size is restricted for shipping, cost, or other reasons, the power output shaft housing can occupy a large percentage of the available volume of the collector box which in turn increases local velocities in some areas and blocks exhaust gas in others. This arrangement may increase the velocity differentials in the collector box, promote destructive vibrational and acoustical forces, and increase back pressure.

Prior to the invention disclosed below, the most efficient collector box designs utilized large volume, divergent conical tailpipes, and in the case of gas turbines with power output shafts in the collector box, divergent power output shaft housing. These collector boxes are done in smaller or mid-range gas turbines where the collector box can be large in relation to the last stage of turbine diameter so the maximum tailpipe outlet exhaust velocities can be reduced, thereby lowering the differential exhaust velocities within the collector box and making any stalls or turbulence less likely to cause destructive vibration. This design also recovers spin energy, if any, in the exhaust flow.

For a few turbines the most efficient collector box designs have radial turning vanes to straighten the spinning flow in the tailpipe. However, these radial vanes may result in tailpipe stalls when the tailpipe is divergent. This design is typically found in smaller units, particularly those with a radial turbine element in the power turbine.

For reference, in all succeeding discussions, the turbine axis is deemed horizontal and the exhaust outlet is upward. One prior art approach for improving turbine exhaust collector box flow efficiency is to install a streamlined fairing on the bottom and top of the power output shaft housing to streamline the flow over the housing, sometimes in combination with conventional turning vanes in a rack. (The bottom is the side away from the collector box exit.) This system is effective when the power output shaft housing has a small diameter in relation to the width of the collector box, but is not used for practicality and cost reasons. In larger turbines, where the collector box is relatively smaller compared to the shaft housing, the fairings have shown to be far less effective and are generally ineffective.

Another approach to improving collector box flow efficiency is to add turning vanes, of various designs but usually ring-shaped and in a rack, to improve the flow distribution inside the tailcone and collector box. These have been partially successful where the collector box has large size compared to the last stage turbine outlet. However, they do not solve the specific problem of stalls in all the identified problem areas. They also are under high mechanical stress, constant vibration, and thermal stresses which can cause them to fail, sometimes over a short period of time. Successful turning vanes are expensive, but still allow large scale turbulence that often causes noise and destruction of wall insulation and coverings.

To reduce roughness and flow separations in the divergent engine tailpipe, obstructions and fillers have been installed in the lower half of the tailpipe (on the side opposite the collector box exit) to increase the flow velocity in this area. This velocity increase reduces the probability of stall formation in the tailpipe. Although this arrangement improves flow stability, the increased velocity also reduces the expansion effects of the tailpipe and thereby reduces the pressure and power recovery compared to a stall-free exhaust expansion. Also, smaller transient stalls or roughnesses may still form in the tailcone or collector box, and there is relatively high velocity collector box turbulence, which indicates that the basic problem has not been completely solved.

In most turbo machines, including radial, axial, and mixed flow compressors, the compressor section ends in a duct of expanding area, most often of generally annular shape for axial flows and of axially divergent shape for mixed or radial flows.

In both cases, there also may be one or more bends. Some radial or mixed flow compressors also include a volute shape. This duct of expanding area decelerates flow, converting some kinetic energy to pressure energy. Sources of flow losses are as discussed previously.

The typical 1 to 1.8 expansion ratio duct would, by previous technology, terminate in a receiving volume that also contains the fuel combustion can. The addition of a bypass passage leading from each side of the expansion duct near its outlet and downstream of struts and releasing flow into the tail end of the combustor and into the turbine area where it rejoins the main flow allows the inlet duct expansion ration to be increased to 2.5 to 1 or 3.5 to 1 with excellent stability and flow smoothness. In terms of efficiency, improvements will vary from one turbine to another, but 1.0 to 4 percent compressor efficiency improvements are estimated.

SUMMARY OF THE INVENTION

This invention relates to an improved system for enhancing flow efficiency and for preventing the formation of stalls, resulting in improved turbo machinery efficiency, reduced noise, and reduced vibration. The invention also relates to the process and to the method for implementing this improved system.

In accordance with the present invention, an improved efficiency flow enhancement system is provided for a duct system downstream of blading in a turbo machine, comprising the blading, a duct leading from the blading, two or more passages defined at least in part by partitions which take flow from within the duct, or from across its outlet, or from within four duct widths downstream of its outlet, the partitions defining at least partially separated flow passages intended for flows leaving the expanding duct of generally different mechanical energy, one or more zones of significant pressure drop for the flows of higher energy, one or more passages of comparatively less pressure drop for the passages with flows of lower mechanical energy, one or more zones where the flows are rejoined, and an outlet. In particular, the flow is introduced from the axial, radial, or mixed flow blading of a turbo machine into an inlet duct of generally expanding area, where the zone of pressure drop includes one or more of a passage, bend, cross section area change, a duct with high drag or grid, and the zone of rejoining flows includes one or more of a passage, a duct, or an enclosed space. In more particular, the means of pressure decrease includes one or more of a gas turbine combustor or portions thereof, a heat exchanger or portion thereof including any connecting ducts, one or more bends, portions of a collector box or receiver, a silencer or portions thereof, a catalytic converter or portions thereof, turbines and turbine nozzles including adjacent spaces, one or more stages of turbine blading, and the means of rejoining may include one or more of one or more turbine stages, turbine nozzles and adjacent spaces, the downstream three-fourths portion of a combustor, one or more bends, a collector box or enclosed receiver including portions thereof, a silencer or portions thereof, a catalytic converter or portions thereof, or an empty space or duct. For the important case where the duct downstream of the blading has an expanding area so that the static pressure may rise at the larger outlet end compared to the inlet end, the following novel process occurs.

As illustrated in FIG. 8, one or more minor flows is diverted from the expanding area duct at locations of relatively low mechanical total flow energy, specifically where the total pressure (static plus kinetic) is 95 percent or less than the maximum at the cross section of the diversion point, which locations are normally adjacent to the duct walls, downstream in wakes of struts, or in areas subject to slowed flow in or near bends, and this low energy flow bypasses a downstream pressure drop, such as a combustor or bend, and rejoins the un-diverted high energy flow downstream of the pressure drop, the major flow having less static pressure at each point of rejoining than at the corresponding minor flow takeoff location at the expanding duct. This significant pressure drop in the major flow allows the removal of low mechanical total energy flow from the expanding duct. The pressure regain efficiency of the expanding duct is thereby enhanced, and made steadier and more stall resistant, more stable, and less noisy. The terms "major flow" and "minor flow" are fully descriptive only where only a small amount off low is diverted; for a sharp bend, the "major flow" of high energy may actually have less flow volume than the diverted lower energy "minor" flow.

Application of the subject invention to an industrial gas turbine in wide use, the General Electric LM 2500 (manufactured by General Electric Corp., Cincinnati, Ohio) will produce the following fuel savings, or alternately, power increases, based on precision scale model tests. For application to the exhaust only, the fuel burn rate, or efficiency, will improve by 2 to 3 percent. For the compressor outlet, the additional improvement is estimated at 0.5 to 2.0 percent. Noise, vibration, and downstream duct maintenance will be reduced. In many industrial and marine uses, the need for exhaust muffling will be greatly reduced or totally eliminated, a major achievement.

DETAILED DESCRIPTION OF THE PREFERRED EMBODIMENT

Figure 1:
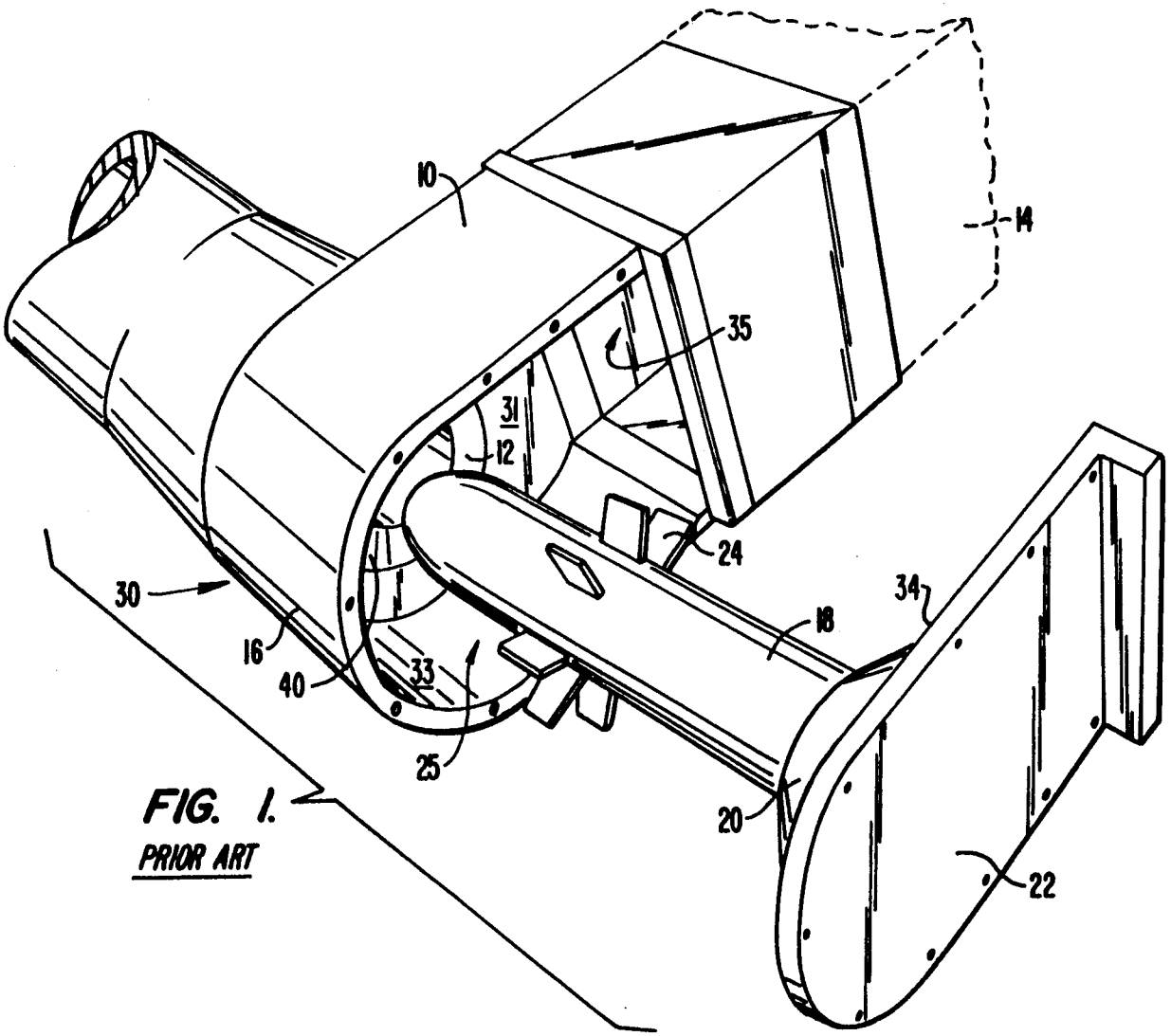
FIG. 1. PRIOR ART
FIG. 1 is an expanded respective view of prior art a conventional gas turbine exhaust collector box and exhaust outlet.

The turbine exhaust system of this invention uses partitions and turning vanes of particular size, shape and placement to develop low pressure zones sufficiently near known stall areas to urge the exhaust to flow through or around the potential stall zone without allowing flow pattern switching or flow reversals to develop. The pulling action also reduces roughness stalls. These partitions also partially equalize the exhaust flow velocity at and in the collector box outlet. The method for determining the size, shape and placement of the partitions is part of this invention.

The preferred method for determining the size, shape and placement of partitions in a turbine collector box is a five step process. The first step is to construct a scale model of the turbine exhaust system. When modeling the system, it is important to maintain a Reynolds number greater than 10,000 for flow through the throat of the turbine exit cone. This is to make sure that the flow in the model collector box is turbulent. In the modeling discussed below, a one-eighth scale was used. It should be understood, however, that any scale may be used so long as the model can be scaled up or down conveniently.

Feathers, wired tassels, smoke or vapor condensation or other means are installed to show flow patterns within the model. The model is operated at full flow or partial flows so that a flow survey can be performed. The tassels on the tailpipe and the walls of the collector box are observed to find indications of local stalls and flow switching. Stalls will show up as tassels which slow a flow opposite to the general flow pattern in a specific area. Flow switching occurs when a stall exists for a short time, then disappears resulting in a major change of flow direction as indicated by the reversal of the direction shown by the tassel in the area and a change in the system sound. The tassels on the tailpipe and walls of the collector box are located in the boundary layer and do not tell the full story.

An additional survey using a tassel mounted on a probe is used to determine flow direction in the main flow stream. Several traverses of the tailpipe outlet, the collector box sides, and the collector box outlet will establish information concerning areas where notices are located and where high and low velocity zones can be found. The data from the survey must be recorded to become the system baseline data. This will be used to determine the level of improvement made through the placement of the partitions.

The second step in determining the size, shape and placement of the partitions is to calculate the theoretical maximum volumetric flow rate of exhaust gas through the collector box. The collector box is divided into a plurality of sectors, and a standard fluid mechanics algorithm is used to determine the theoretical flow rate of exhaust gas through that sector. The algorithm which should be used to develop the flow in the various sectors is percent of flow per unit area. This simplifies the calculations because it eliminates the need for predicting local temperatures and density variations in the exhaust stream. The assumption is that 100 percent of the flow which exits the tailpipe will also exit from the collector box outlet. The size and number of sectors used in this analysis depends on the desired accuracy. Smaller sector sizes and greater numbers of sectors will increase the accuracy of the calculation.

An example of a theoretical calculation is as follows. A collector box used with some General Electric LM 2500 gas turbines is shown in FIG. 1. The collector box 10 lies between the outlet cone 12 of the turbine and the system exhaust duct 14. By arbitrary convention, exhaust duct 14 is at the top of the system (i.e., duct 14 is vertical), and reference numeral 16 indicates the bottom of the system.

A turbine shaft housing 18 is disposed along the centerline of turbine outlet tail cone 12. Shaft housing 18 expands into a shaft cone 20 at the outer wall 22 of collector box 10. A plurality of radial spacers or struts 24 which support the rear bearing and maintain shaft housing 18 in the center of the turbine outlet. The model shown in FIG. 1 omits the turbine shaft which would extend through wall 22 in actual operation. The dimensions of the model are one-eighth the dimensions of the actual turbine outlet and collector box.

Figure 2:
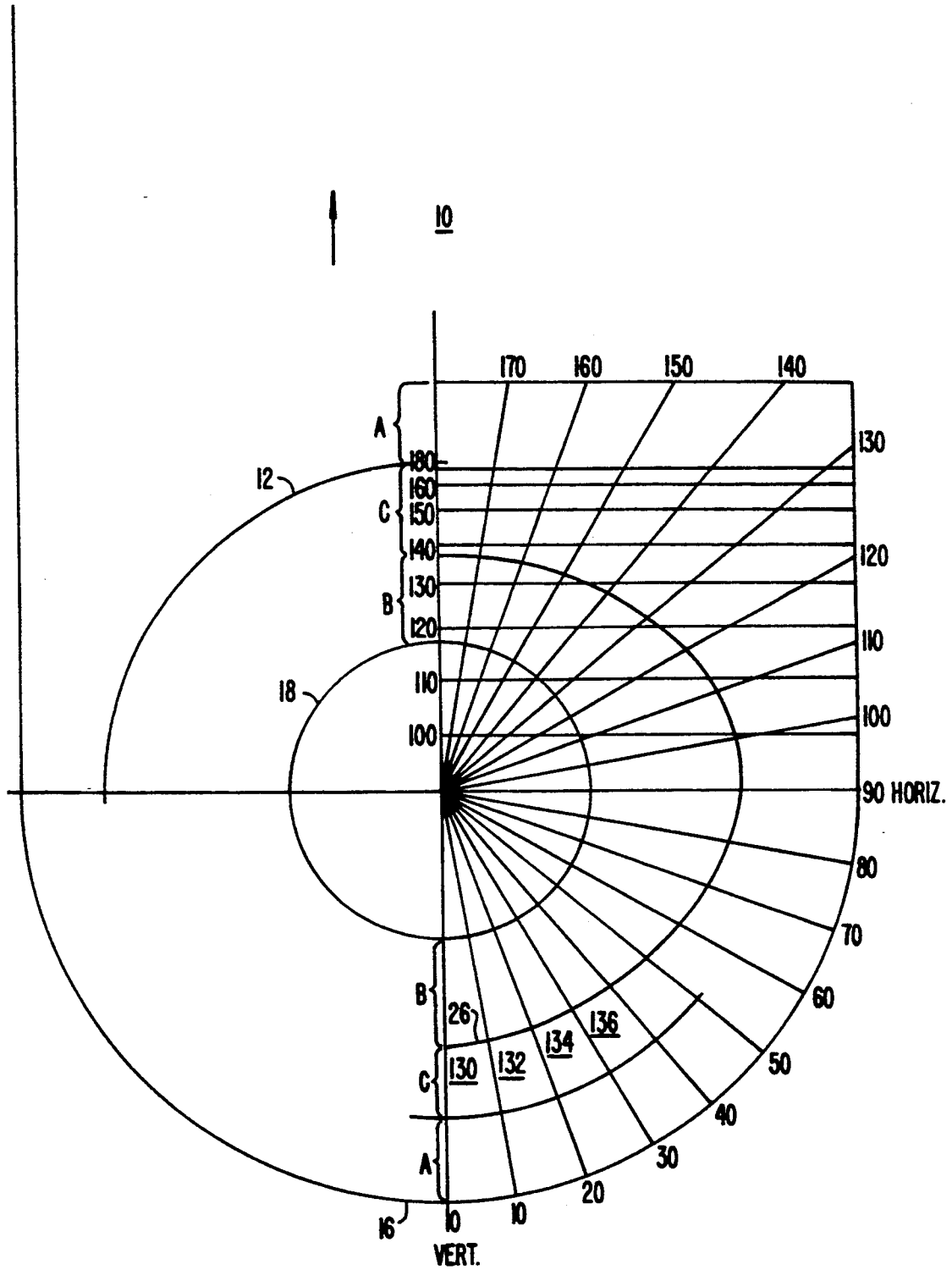
FIG. 2 is a vertical sectional view of the calculation grid shown superimposed over the vertical plane of the tail pipe exit.
Figure 3:
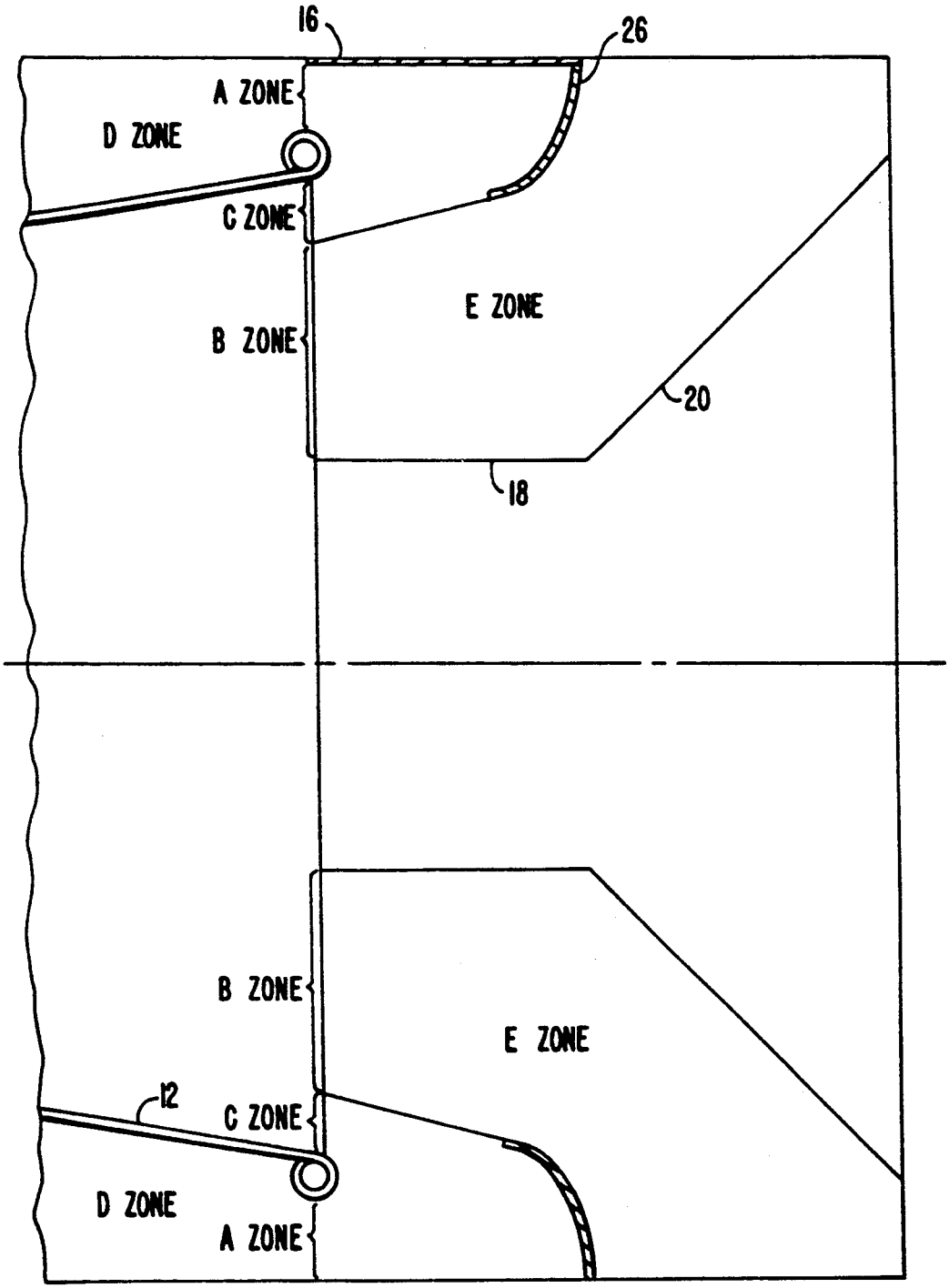
FIG. 3 is a horizontal section of the turbine collector box and outlet cone taken along the horizontal plane through the centerline of collector box.

Results of the scale model tests showed that stalls were occurring within the turbine outlet tail cone 12 and on the external surface of the output shaft housing 18. The tests also showed that the collector box area 25 beneath and around the outlet cone 12 was under-utilized, i.e., it had lower than average flow velocity. The scale model flow tests indicated, therefore, that a flow partition or partitions could be used to create a low pressure area downstream of the outlet tail cone bottom by directed a portion of the exhaust flow through area 25. In addition, the partition or partitions could be used to create low pressure zones downstream of the stalls on the shaft housing. The next step was to determine the shape and placement of the partition or partitions. The theoretical calculations for the flow through the collector box is done on three planes. The first is a plane which cuts through the collector box at the exit of the turbine tailcone, is perpendicular to the turbine centerline and parallel to the back wall of the collector box as shown in FIG. 2. Calculations of flow in this plane will determine what flow areas are available to be utilized around the exit of the turbine tailpipe. The second is a plane cut through the horizontal centerline of the collector box which is parallel to the plane of the collector box outlet. (FIG. 3). This plane is used to determine the exhaust flow loading between the front of the collector box and the back of the collector box at the point of greatest restriction. The third is a plane cut through the collector box at the outlet which is parallel to the collector box outlet and parallel to the back wall of the collector box. Calculations of flow in this plane show the relative proportions of flow on the front and back of the initial partition.

FIG. 2 is a schematic view of the turbine outlet in the plane of the outlet tail cone exit. This drawing is used to calculate the theoretical effect that a partition would have on the turbine exhaust flow. The partition design process is iterative. A partition shape is superimposed on the grid of FIG. 2 and flow calculations are performed to measure the effectiveness of the chosen shape. The goal of the partition design is to balance the flow on either side of the partition and to keep the flow in any given sector below the exhaust velocity of the turbine. The ideal distribution between the front and the back of the partition is 50 percent in front and 50 percent in back. The calculated distribution may favor one side or the other by up to 30 percent to 70 percent, respectively, during the development of the initial partition design. The flow rate is preferably expressed in percent flow per square foot to eliminate variations caused by changes in exhaust gas temperature and pressure.

The flow area in the collector box remains constant around the circumference of the exhaust cone 12 and shaft housing 18 below the horizontal centerline of the collector box. Since the collector box flow area increases above the horizontal centerline, however, the theoretical flow calculation is performed differently in that section. Thus, below the horizontal centerline, the flow area is divided into radial sectors starting at the vertical centerline at the bottom 16 of the collector box and moving around the outlet cone 12 in ten degree increments. Above the horizontal centerline, the flow area is divided into rectangular sections bounded by horizontal lines drawn through the intersection the exhaust cone outline with radii drawn in ten degree increments. Line 26 is the edge of a theoretical flow partition placed at the outlet plane of outlet cone 12.

The partition design process is iterative. A partition shape is superimposed on the radial grid of FIG. 2 and flow calculations are performed to measure the effectiveness of the chosen shape. The goal of the partition design is to balance the flow on either side of the partition and to keep the flow in any given sector below the exhaust velocity of the turbine. The flow rate is preferably expressed in percent flow per square foot to eliminate variations caused by changes in exhaust gas temperature.

FIG. 3 is a schematic of the turbine collector box and outlet cone taken along the horizontal centerline of collector Box. FIG. 3 shows five flow zones A–E. Zone A is the space between the collector box wall and the outer surface of the outlet con 12 for flow in the plane of the Figure from right to left. Zone B is the annular space between the turbine shaft 18 and an imaginary extension of the theoretical partition 26 to the cone outlet for flow in the plane of the Figure from left to right. Zone C is the annular space between the imaginary extension of the partition 26 and the inside surface of the outlet cone 12 for flow in the plane of the Figure from left to right. All of the exhaust gas flowing through Zone C goes into Zone D, which is the area between the collector box wall and the extended partition line, with flow substantially perpendicular to the plane of the Figure. All of the exhaust gas flowing through Zone B goes into Zone E, which is the area between the partition and the shaft housing with flow perpendicular to the plane of the Figure. Zones A through C are also shown on FIG. 2.

The effect of the theoretical partition on the flow in each sector of FIG. 2 through Zones A–E is shown in Tables 1–4. Table 1 shows for Zones A–C the available flow area in square inches for each sector (radial sectors below 90° and rectangular above) and the accumulated flow area. The calculations are based on the following dimensions: a shaft having an outer diameter of 30 inches; a turbine exhaust outlet inner diameter of 64 inches; a turbine exhaust outlet outer diameter of 69.75 inches; a collector box bottom half of 80 inches; and a collector box outlet area of 4400 square inches. For example, the four sectors 130, 132, 134 and 136 in FIG. 2 each have an area of 33.3 sq. inches. These values are recorded in the first four rows of the "C Zone" column of Table 1.

TABLE 1

| | FLOW AREA (SQ. IN.) | | | | | |
|---|---|---|---|---|---|---|
| LOCATION | C ZONE | C ACCUM | B ZONE | B ACCUM | A ZONE | A ACCUM |
| 0–10° | 33.3 | 33.3 | 36.43 | 36.43 | 33.49 | 33.49 |
| 10°–20° | 33.3 | 66.6 | 36.43 | 72.86 | 33.49 | 66.98 |
| 20°–30° | 33.3 | 99.9 | 36.43 | 109.29 | 33.49 | 100.47 |
| 30°–40° | 33.3 | 133.2 | 36.43 | 145.72 | 33.49 | 133.96 |
| 40°–50° | 32.17 | 165.37 | 37.56 | 183.28 | 33.49 | 167.45 |
| 50°–60° | 30.37 | 195.74 | 39.36 | 222.64 | 33.49 | 200.94 |
| 60°–70° | 27.38 | 223.12 | 42.35 | 264.99 | 33.49 | 234.43 |
| 70°–80° | 22.88 | 246.00 | 46.88 | 311.84 | 33.49 | 267.92 |
| 80°–90° | 18.48 | 264.48 | 51.25 | 363.09 | 33.49 | 301.41 |
| 90°–100° | 17.4 | 281.88 | 86.91 | 450 | 36.725 | 338.135 |
| 100°–110° | 19.25 | 301.13 | 85.955 | 535.955 | 46.24 | 384.375 |
| 110°–120° | 27.04 | 328.17 | 108.21 | 644.165 | 67.55 | 451.925 |
| 120°–130° | 37.49 | 365.66 | 91.135 | 735.3 | 116.8 | 568.725 |
| 130°–140° | 56.48 | 422.14 | 29.4 | 764.7 | | |
| 140°–150° | 62.73 | 484.87 | 0 | 764.7 | | |
| 150°–160° | 34 | 518.87 | 0 | 764.7 | | |
| 160°–170° | 10.855 | 529.725 | 0 | 764.7 | | |
| 170°–180° | 2.195 | 531.92 | 0 | 764.7 | | |

Table 2 shows the percentage of the turbine exhaust flowing through Zones A–C for each sector. Thus, the value in the first row of the "C Zone" column of Table 2 is derived by dividing the 33.3 sq. in. area from Table 1 by the entire annular flow area of the turbine outlet, 2510 sq. in. The "B Accum" and "C Accum" columns are running totals of the "C Zone" and "B Zone" columns, respectively.

TABLE 2

| | PERCENT FLOW AREA | | | |
|---|---|---|---|---|
| LOCATION | C ZONE | B ZONE | C ACCUM | B ACCUM |
| 0–10° | 0.013 | 0.015 | 0.013 | 0.015 |
| 10°–20° | 0.013 | 0.015 | 0.026 | 0.03 |
| 20°–30° | 0.013 | 0.015 | 0.039 | 0.045 |
| 30°–40° | 0.013 | 0.015 | 0.052 | 0.06 |
| 40°–50° | 0.0128 | 0.015 | 0.0648 | 0.075 |
| 50°–60° | 0.12 | 0.0156 | 0.0768 | 0.0906 |
| 60°–70° | 0.011 | 0.017 | 0.0878 | 0.1076 |
| 70°–80° | 0.009 | 0.019 | 0.0968 | 0.1266 |
| 80°–90° | 0.007 | 0.02 | 0.1038 | 0.1466 |
| 90°–100° | 0.0065 | 0.0324 | 0.1103 | 0.179 |
| 100°–110° | 0.00719 | 0.0321 | 0.11749 | 0.2111 |
| 110°–120° | 0.01 | 0.04 | 0.12749 | 0.2511 |
| 120°–130° | 0.014 | 0.034 | 0.14149 | 0.2851 |
| 130°–140° | 0.021 | 0.011 | 0.16249 | 0.2961 |
| 140°–150° | 0.023 | 0 | 0.18549 | 0.2961 |
| 150°–160° | 0.013 | 0 | 0.19849 | 0.2961 |
| 160°–170° | 0.0041 | 0 | 0.20259 | 0.2961 |
| 170°–180° | 0.00082 | 0 | 0.20341 | 0.2961 |

As FIG. 2 and Tables 1 and 2 show, the partition remains at a constant distance from the outlet cone surface between 0 and 40 degrees to divide the flow of Zones B and C into approximately equal portions. After the 40° mark, however, the accumulated flow in Zone D is reduced in small increments to prevent a choking of the accumulated flow at the centerline. That is, the flow rate per unit area added to the flow in already in Zone D is reduced before the flow rate per unit area at the horizontal centerline begins to exceed the exhaust flow rate per unit area at the turbine cone outlet. The outer periphery of the partition therefore begins to move away from the shaft housing and the inner edge moves back from the cone outlet to divert a smaller portion of the exhaust gas into Zone D.

The partition continues to move away from the shaft housing up to a point between the horizontal centerline (90°) and the 100° point. Above the horizontal centerline, the collector box flow area begins to increase. The partition edge therefore then begins moving closer to the shaft housing to take progressively larger portions of the exhaust gas flow to divert that flow into Zone D.

TABLE 3

| | AREA TABLE SQ. IN. | | |
|---|---|---|---|
| LOCATION | TOTAL | D ZONE | E ZONE |
| 0° | 914.9 | 261.8 | 653.14 |
| 10° | 914.94 | 263.7 | 651.24 |
| 20° | 914.94 | 267.4 | 647.54 |
| 30° | 914.94 | 271.2 | 643.74 |
| 40° | 914.94 | 276.8 | 638.14 |
| 50° | 914.94 | 282.42 | 632.52 |
| 60° | 914.94 | 286.35 | 628.59 |
| 70° | 914.94 | 301.24 | 613.7 |
| 80° | 914.94 | 313.86 | 601.08 |
| 90° | 914.94 | 322.28 | 592.66 |
| 100° | 975.50 | 344.03 | 631.47 |
| 110° | 1119.525 | 398.70 | 720.825 |
| 120° | 1415.925 | 497.895 | 918.03 |
| 130° | 1577.23 | 624.73 | 952.5 |
| 140° | 1737.1 | 861.265 | 875.835 |
| 150° | 1906.02 | 1037.74 | 868.28 |
| 160° | 2097.855 | 1217.685 | 880.17 |
| 170° | 2179.575 | 1303.78 | 875.795 |
| 180° | 2197.075 | 1340 | 857.075 |
| Outlet | 2200 | 1340 | 860 |

Table 3 shows the flow areas of Zones D and E corresponding to different locations in the collector box. Location 0 degrees corresponds to the view in FIG. 3. Locations 10–90 degrees correspond to planes rotated by 10 degree increments about the shaft axis. Above 90 degrees, the slices are taken in horizontal planes corresponding to lines 100–180 degrees of FIG. 2. The final entry indicates the areas at the collector box outlet.

Table 4 shows the results of the theoretical flow calculations for positions at the horizontal centerline and at the vertical centerline or collector box outlet. The goal is to equalize (as much as possible) the percent flow per square foot in Zones D and E at the two positions. The numbers for the D Zone and E Zone accumulated flow at the horizontal centerline and at the outlet are taken from Table 2 as shown by the italics in Table 2. The available flow areas come from Table 3.

TABLE 4

| RELATIVE FLOW VELOCITIES | D ZONE | E ZONE |
|---|---|---|
| Accum flow, horizontal centerline | 10.83% | 14.66% |
| Available flow area, horizontal centerline | 322.28 (sq.in.) | 591.96 (sq.in.) |
| % flow/sq.ft., horizontal centerline | 4.638 | 3.566 |
| Accum flow, outlet | 20.34% | 29.61% |
| Available flow area, outlet | 1340.0 (sq.in.) | 860.0 (sq.in.) |
| % flow/sq.ft., outlet | 2.186 | 4.958 |

The calculation converts the flow areas into square feet and divides the areas into the accumulated flow percentages to yield the percent flow per square foot parameters for Zones D and E at the horizontal centerline and at the collector box outlet (vertical centerline). As Table 4 shows, the results at the horizontal centerline are 4.638 for Zone D as compared to 3.566 for Zone E. The results at the vertical centerline are 2.186 for Zone D and 4.958 for Zone E. Since the flow values are the horizontal and vertical centerlines are inversely related, it is difficult, if not impossible, to equalize the D and E Zone flow values at both the horizontal and vertical centerlines. The flow parameters for the partition configuration shown in FIG. 2 represent a good approximation of the optimum condition.

Figure 4:
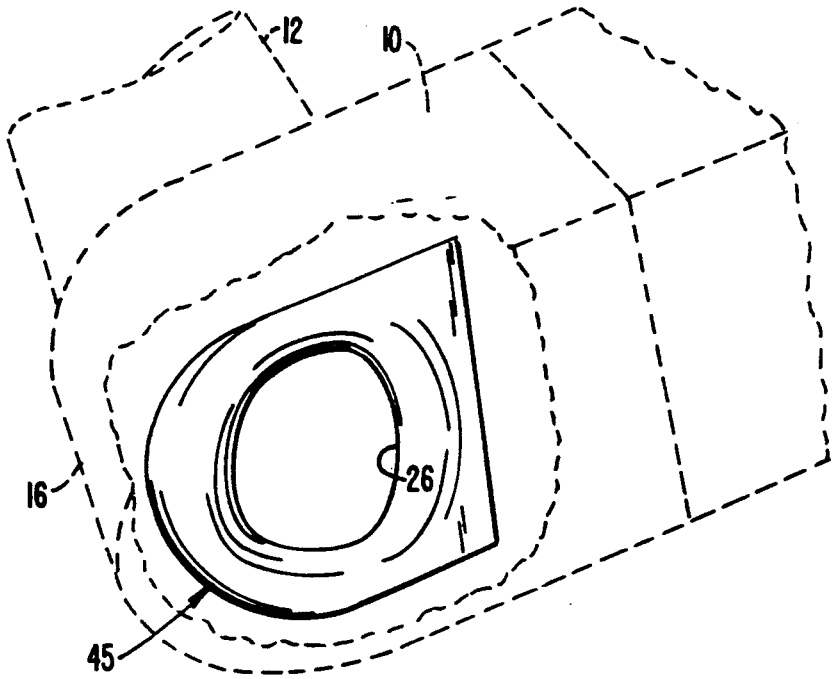
FIG. 4 is a perspective view showings the collector box of FIG. 1 in broken lines with an alternative embodiment of the invention having a single piece partition which offers simplicity, but less performance.

The flow calculations of Tables 1–4 show that the theoretical partition shape shown in cross section in FIG. 2 is a good first approximation of the final partition shape. In the third step of the preferred method, the theoretical shape of the partition is modified to provide smooth flow transitions across the partition, thereby preventing flow separations on the upstream or downstream sides of the partition. The partition shape derived by the sample calculations above is shown in FIG. 4. The fourth step of the preferred method is to make a model of the partition and to test it in the model of the collector box. Feathers, tassels or other means may be used to determine whether the partition has effectively corrected the flow reversal problems. Flow tests on a model of the partition discussed above for the GE LM 2500 turbine showed that the partition eliminated many of the stalls and flow reversals observed in the absence of the partition in the step one test.

Figure 5:
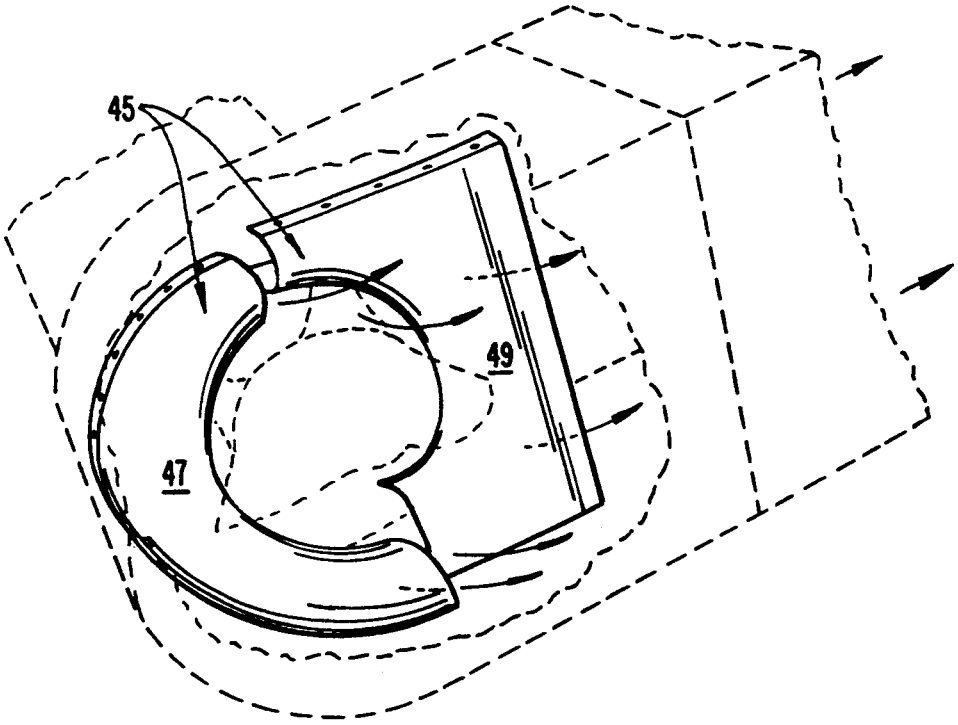
FIG. 5 is a perspective view similar to FIG. 4 which shows a preferred embodiment of the invention.
Figure 8:
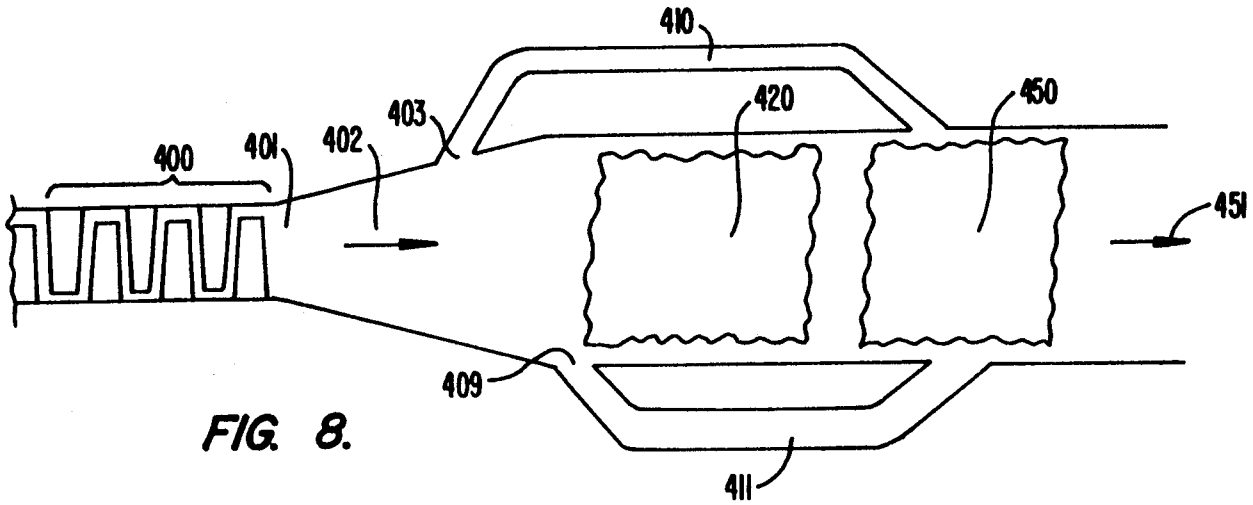
FIG. 8 shows in schematic form the essential elements of the divided flow high-efficiency turbo machine process, including a compressor or turbine outlet, the divided flow paths, the main flow path pressure drop zone, and a rejoin zone of lower pressure.

Finally, fine tuning may be done on the partition by observing the effect of partition shape and placement changes on the collector box flow as shown by the feathers or wired tassels. For example, the ring partition shown in FIG. 4 generated stalls on the back side of its upper half, approximately 40° on either side of the vertical centerline, as evidenced by the flow tassels and by small fluctuations in the pressure drop measured across the collector box. The partition was therefore split in two, and the two pieces were offset and extended across the horizontal centerline to overlap as shown in FIG. 5. This arrangement pushed high pressure flow up over the back side of the upper partition to prevent separation of the flow stream before the partition's trailing edge. The split partition of FIG. 5 lowered the overall collector box noise level and reduced the flickering of the manometer connected across the collector box.

The calculated and empirical development process which is used to develop the partition design must be repeated if the partition system fails to improve the flow in the collector box. If the partition system testing indicates that major revisions are required to gain additional performance, then the steps outlined above can be applied to either a part or the whole partition to further refine the design. As an example, during the testing and refining process for the lower portion of the split partition, tests indicated that the flow which passes between the shaft housing end the lower partition was disorganized. So a flow calculation was performed, and a modification to the lower partition was made which further improved the performance and increased the stall resistance of the system.

The development process described above results in the design of the preferred embodiment consists of the flow enhancement system and three optional improvements which can provide an incremental performance improvement but may be omitted for economic reasons. With respect to FIG. 1, the turbine engine has a tailcone 12 which penetrates the front wall of the collector box assembly 30. The collector box assembly 30 consists of an outer shell 33, a front wall 31, a back wall 34, and an exit 35. The exit 35 can be located from 0 to 360 degrees from vertical but as a point of reference it will be considered to be at 0° or the top position. Inside the tailcone 12 there is a shaft cover 18 located on the centerline of the turbine engine. The shaft cover 18 is flared at the coupling cover or shaft cane 20 which is attached to the back wall 34. In this configuration, when the turbine engine is operating, the hot exhaust gas exists from the tailcone 12 and flows over the outside of the shaft cover 18 where it hits the coupling cover or shaft cane 20 then the back wall 34 and out the exit 35 of the collector box 30. Due to the configuration of the collector box assembly 30, stalls 40 have been found on the inside surface of the tailcone 12 at the bottom (180 degrees from the exit 35) and on the external surface of the sides of the shaft cover 18.

Under some operating conditions the stalls 40 will shift flow directions causing vibration and an increase in low frequency engine noise. Referring to FIG. 5. The flow enhancement system 45 mounts inside the collector box 30 near the end of the tailcone 12 and generally perpendicular to the centerline of the turbine engine. The flow enhancement system 45 consists of a lower assembly 47 and an upper assembly 49.

Figure 11:
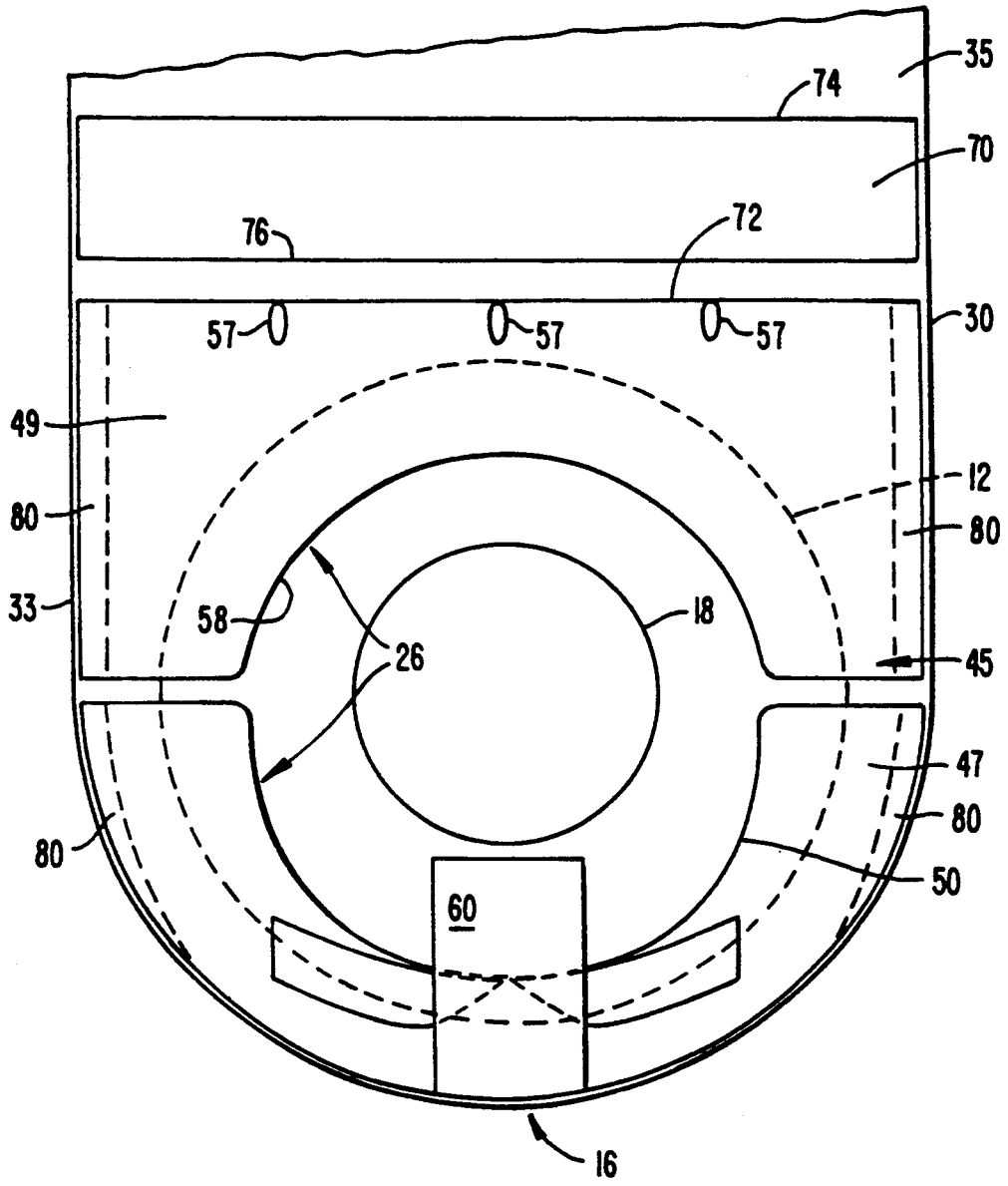
FIG. 11 is an end vertical section looking toward a turbine of preferred embodiment of the invention having the optional slot-wing configuration of a cross section of the preferred embodiment of this invention as illustrated in FIG. 5 with a splitter and flow deflector added shown in the perspective view of FIG. 7.
Figure 12:
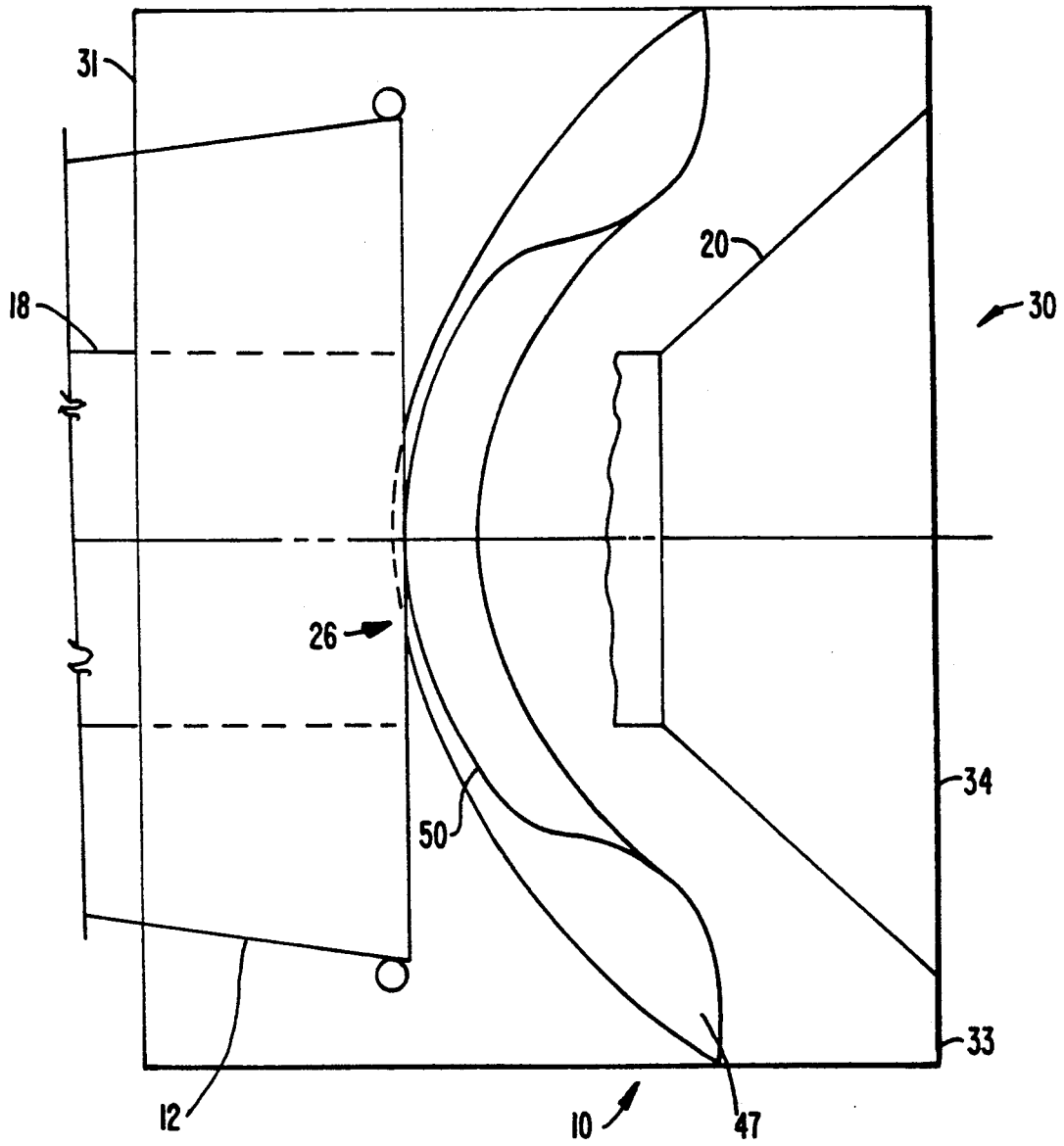
FIG. 12 is a plan view of a cross section of the preferred embodiment of this invention as illustrated in FIG. 5 looking down into the exhaust duct showing the bottom half flow divider.
Figure 13:
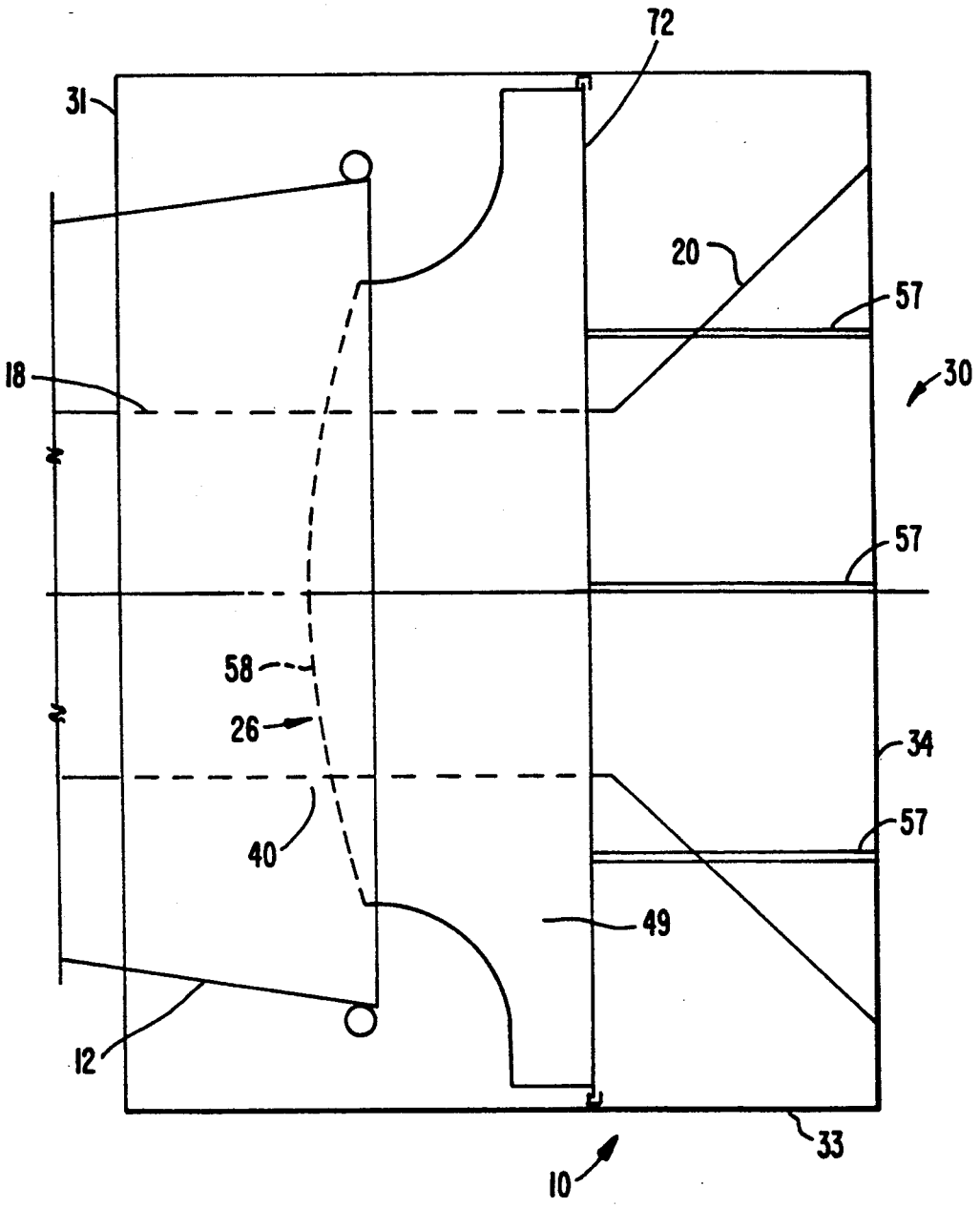
FIG. 13 is a plan view looking up toward the exhaust duct showing the top half flow divider.

Referring to FIG. 12. The lower assembly 47 is a half circular shape which has a concave surface facing the discharge of the tailcone 12. It is designed to intercept a portion of the flow from the exit of the tail cane 12 and vent it around the outside of the tailcone 12 towards the front wall 31 of the collector box 30. The portion of the flow that is intercepted varies with the design of the collector box 30, and the angle from the bottom of the collector box 30. Generally the intercept increases as the lower assembly goes from the bottom towards the horizontal center line of the collector box 30. Referring to FIG. 11. The inside edge 50 of the lower assembly forms the shape of an ellipse with its minor axis aligned with the vertical centerline of the collector box 30. The minor axis is aligned with the horizontal centerline of the collector box 30. The ellipse can have a ratio between the major and minor axis from 1 to 1 to as high as 2.5 to 1. The exhaust gas which is intercepted by the lower assembly 47 is vented towards the front of the collector box 30. This causes a low pressure zone 55 to develop just downstream of the stall 40 inside the lower part of the tailcone 12 (See FIG. 15). The low pressure zone 55 thus pulls the exhaust gas through the stall 40 preventing its formation.

Referring again to FIG. 15, the lower assembly 47 also intercepts a portion of the exhaust gas near the horizontal centerline of the collector box 30 which develops a low pressure zone 55 downstream of the stall 40 on the bottom half of the side of the shaft cover 18. This pulls the exhaust gas through this stall zone preventing the formation of the stall 40. The top of the lower assembly 47 is located behind the bottom of the top assembly 49.

Referring again to FIG. 15. The top assembly 49 is attached to the side walls of the collector box 30 and terminates at the exit 35 of the collector box 30 (See FIG. 15). The top assembly 49 is made up of four subassemblies which bolt together and are supported from the back wall 34 with three struts 57 (See FIG. 15).

Referring again to FIG. 15. One of the subassemblies is removable to allow visual inspection of the last row of blades of the power turbine. The inside edge 58 of the upper assembly 49 intercepts the exhaust flow in the upper half of the tailcone 12 which is vented from the front side of the upper assembly 49 at the collector box 30 exit 35. This exhaust flow on the front side of the upper assembly creates a low pressure zone down stream of the stall 40 on the horizontal centerline of the shaft cover 18. The low pressure zone pulls the exhaust gas through the stall 40 preventing the formation of the stall 40. The exhaust flow which bypasses the upper assembly 49 flows parallel to the upper half of the shaft cover 18 until it impacts on the coupling cover 20 and is directed against the back wall 34 and exits from the collector box. This exhaust steam also tends to block the flow of the exhaust stream which has bypassed the lower assembly 47 and is trying to exit the collector box in the area behind the upper assembly. It is desirable to reduce the amount of exhaust flow that by passes the upper assembly 49 within certain limits.

Referring to FIG. 11. The inside edge 58 of the upper assembly 49 follows the curve of an eclipse with its major axis parallel to the horizontal centerline of the collector box 30. The minor axis is parallel to the vertical centerline of the collector box 30. The eclipse can have a ratio between the major and minor axis from 1 to 1 to as high as 2.5 to 1. The combination of the lower assembly 47 and upper assembly 49 will eliminate the formation of stalls 40 in the tailcone 12 and on the shaft cover 18, however, the collector box 30 still has areas where flow losses can occur.

Three optional improvements can be applied to the flow enhancement system either singly or in combination to further improve the flow through the collector box 30.

Figure 14:
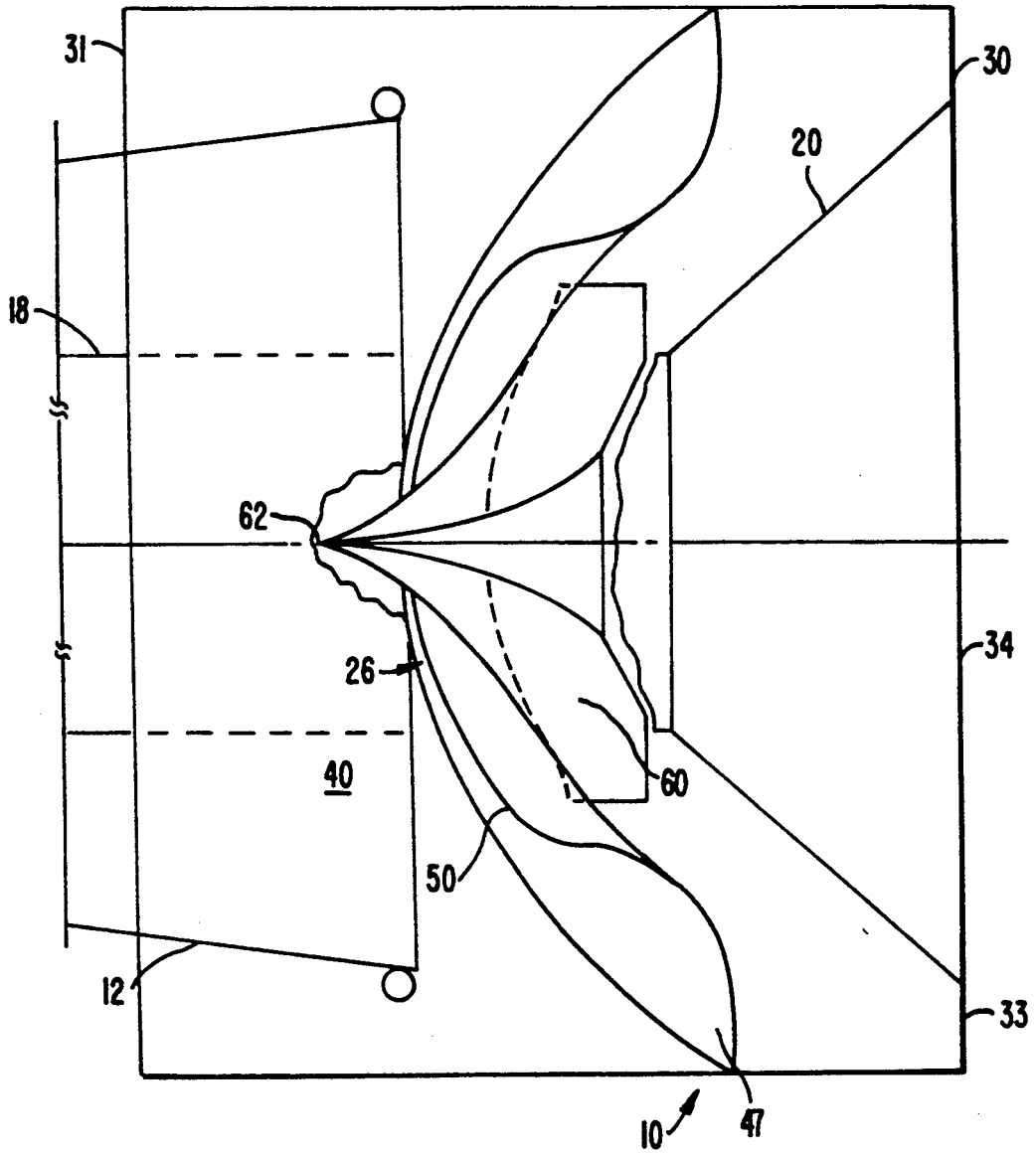
FIG. 14 is a plan view of a cross section looking down into the exhaust duct showing the bottom half flow divider with optional splitter and flow divider further illustrating the embodiment of FIG. 11.

Referring to FIGS. 11 and 14, first is a flow deflector 60 which intercepts the exhaust gas which bypasses the lower assembly 47 prior to its impact on the lower surface of the coupling cover 20. Normally without the flow deflector 60 in place, this portion of the exhaust gas hits the lower surface of the coupling cover 20 and is directed down to the center bottom area of the collector box 30. At this point it loses all of the flow energy until it flows up the sides of the collector box 30 where it is re-accelerated by a fast moving exhaust stream and vented out of the collector box 30 through the exit 35. The flow deflector 60 which is mounted on the top of the center of the lower assembly 47 intercepts the exhaust flow between the top of the lower assembly 47 and the bottom of the shaft cover 18 over an arc of up to 60 degrees. The flow deflector 60 can be mounted directly above the lower assembly 47 or slightly forward or slightly behind the inner leading edge of the lower assembly 47. It splits the flow into two streams on either side of the collector box 30 centerline and directs these streams away from the bottom center area of the collector box. The deflected exhaust streams are directed around the backside of the lower assembly 47 where they impact the side walls of the collector box 30 and turn towards the exit.

The deflected exhaust streams maintain their velocity and energy which in turn improves the efficiency of the flow enhancement system. The flow deflector 60 has a vertical leading edge 62 which is parallel to the centerline of the collector box (See FIG. 14, 15). The vertical leading edge can also have a slope or angle towards the exhaust flow. This slope can be vertical or up to 70 degrees on either side of vertical depending on the shape of the collector box 30 and the distance between the top of the lower assembly 47 and the bottom of the shaft cover 18.

Figure 15:
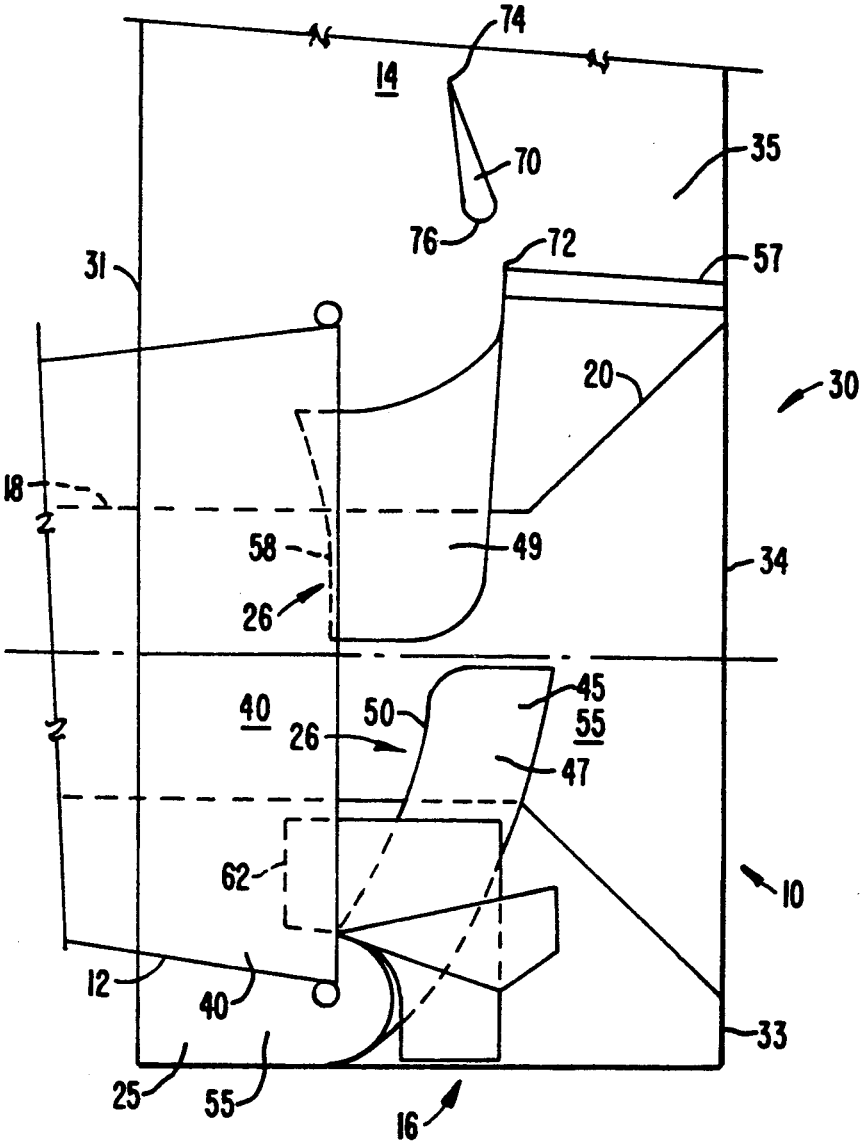
FIG. 15 is a side cross section showing the collector box of the preferred embodiment having a slotted wing plus flow splitter and deflector further illustrating the embodiments of FIG. 11.
Figure 16:
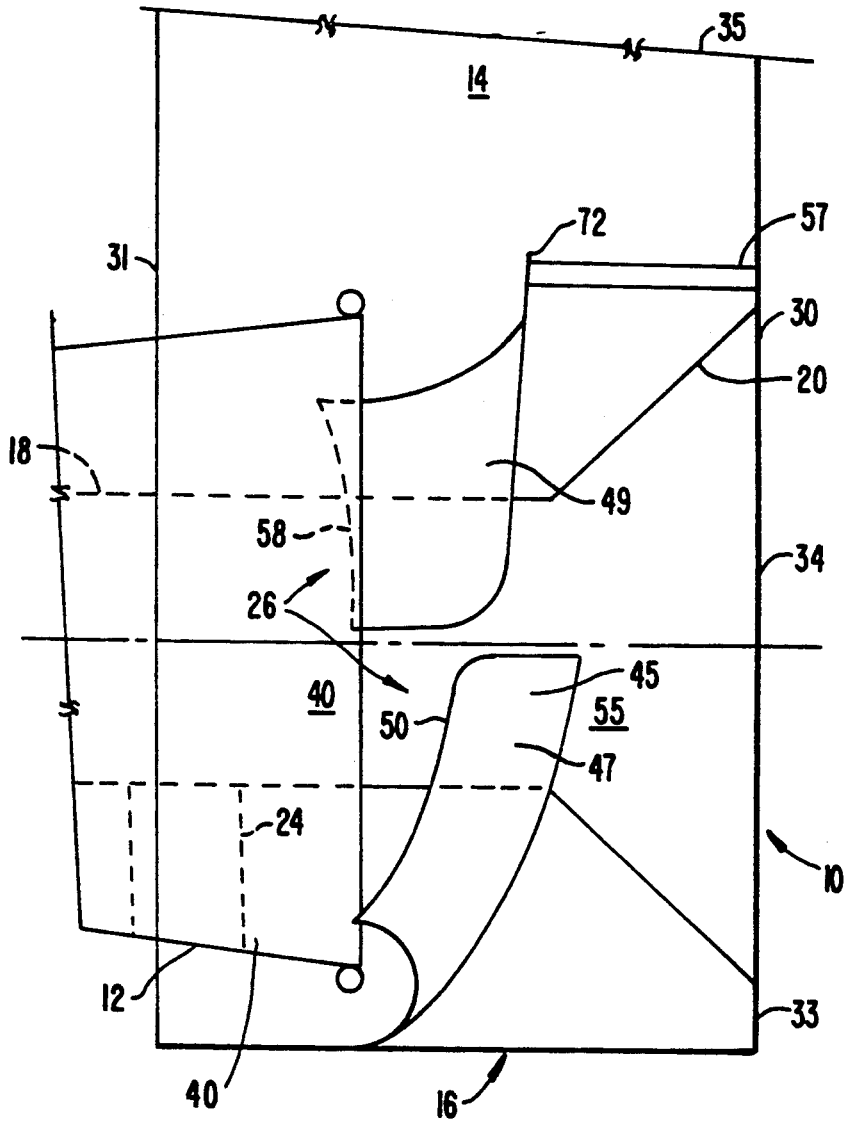
FIG. 16 shows the embodiment of FIG. 15 without a slotted wing or flow splitter or deflector.

Referring to FIG. 15, the second option for the flow enhancer is an airfoil shape 70 which is attached to the top of the upper assembly 49 and is used to even the flow at the collector box 30 exit 5. This option has two functions. It can even the flow of exhaust gas downstream from the collector box 30 exit 35 so that any heat exchangers, silencers, or duct burner systems see a more uniform flow. It can also be used to reduce the duct pressure immediately down stream of the exit 35 on the back side of the upper assembly 49 to draw more of the exhaust flow from that area and improve the system flow efficiency. The airfoil shape 70 is mounted between the side walls of the collector box 70 slightly forward of the top of the upper assembly 49. The leading edge of the airfoil shape 70 may or may not overlap the trailing edge 72 of the upper assembly. The airfoil shape 70 is angled at its trailing edge 74 towards the front wall 31 of the collector box. This angle is less than the stall angle for the airfoil shape 70. The airfoil shape 70 has a leading edge 76 which intercepts the high velocity exhaust stream on the front side of the upper assembly 49. This high velocity exhaust stream forms a boundary layer on the airfoil shape 70 which forms a low pressure area that pulls some of the exhaust flow from the back side of the upper assembly towards the front wall 31 of the collector box 30. This improves the flow on the back side of the upper assembly 49 and provides a better flow velocity distribution in the downstream duct. The third option is to change the shape of the upper assembly 49 and lower assembly 47 to even out the pressure differential between the front of the collector box 31 and the back of the collector box 34. This pressure differential is caused by the momentum of the exhaust gas which bypasses the upper assembly 49 and the lower assembly 47 and collect behind the upper assembly 49 and the lower assembly 47. This pressure differential also increases the velocity of the exhaust gas which is trying to leave the collector box 30 along the back wall 34. Using the percent flow per unit area approach, a calculation can be made to determine how much area is required to vent the exhaust gas in the lower center part of the collector box through slots 80 in the upper assembly 49 and the lower assembly 47.

Referring to FIG. 11, on the lower assembly 47 the slots 80 are placed on the sides of the lower assembly 47 between the lower assembly and the collector box 30 walls on both sides. The slot 80 is not provided from the center of the lower assembly 47 out to 30 degrees on each side because it would alter the pressure in the front bottom of the collector box and allow the stall 40 to reappear in the bottom inside surface of the tailcone 12. The upper assembly will also have a slot 80 between it and the collector box 30 side walls to equalize the pressure between the front and back sides of the flow enhancement system. On each side the total area of the slots should be approximately equal to the area between the top of the lower assembly 47 and the bottom of the shaft cover 18 between the horizontal centerline and the vertical centerline. The exhaust gas which passes through the slots 80 will move towards the front of the collector box 31 and leave the system on the front side of the upper assembly 49.

Figure 6:
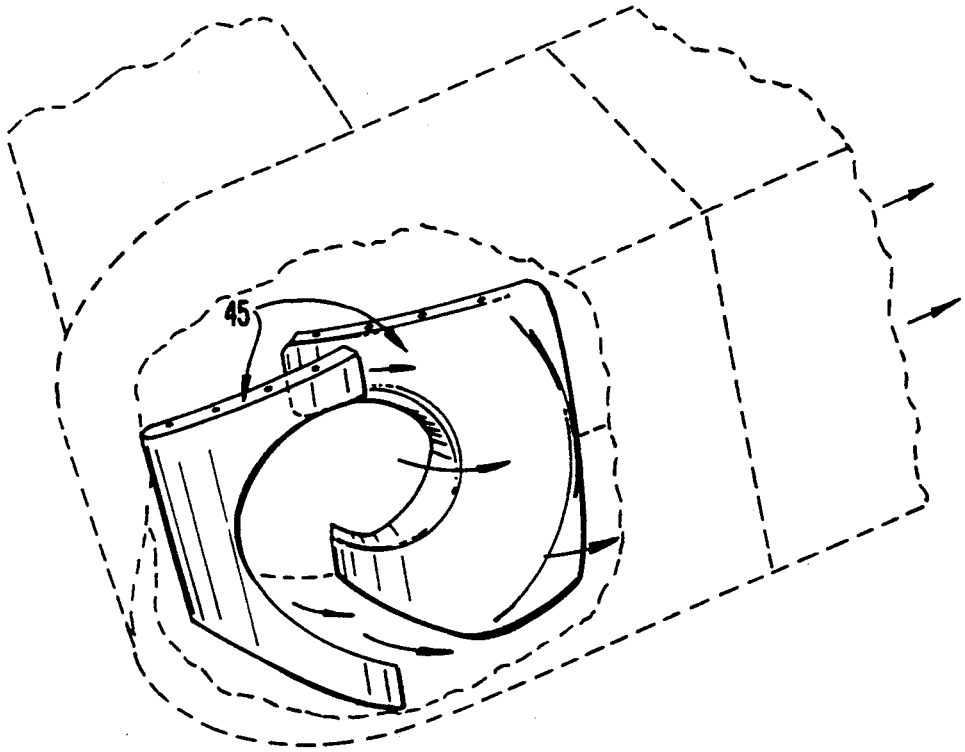
FIG. 6 is a partial perspective view similar to FIG. 4 of an alternate embodiment of the invention intended for collector boxes with relatively small shaft housings.

The split partition of FIG. 5 can be further modified to another streamlined shape. In a second embodiment, a modified split partition is shown in FIG. 6. The partition of FIG. 6 curves more towards the flow and reduces separation of the flow from the surface of the partition.

Figure 7:
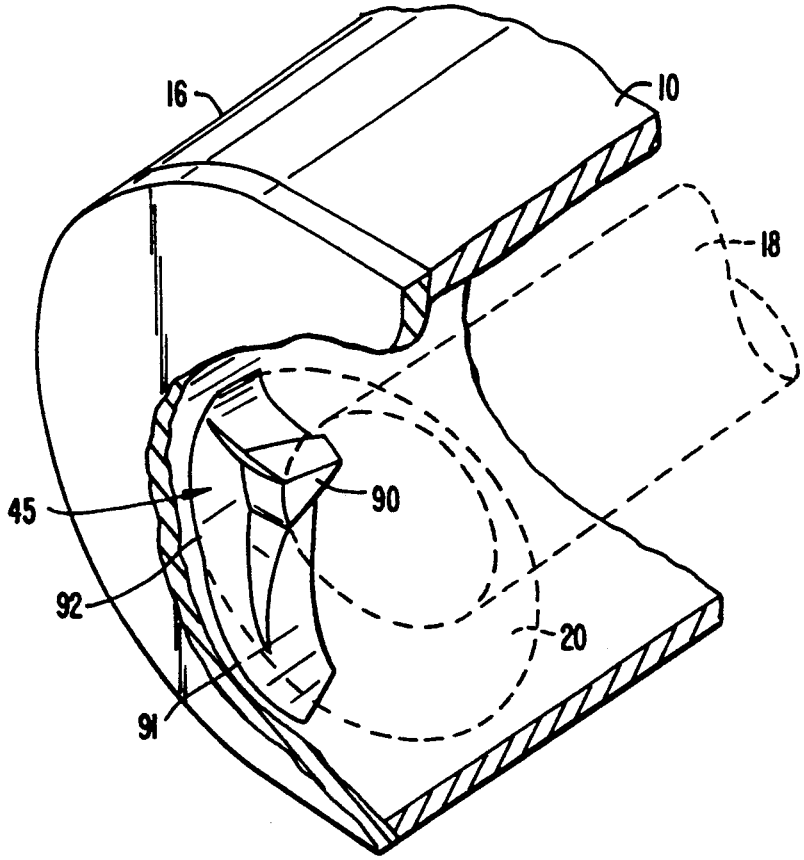
FIG. 7 is a partial cut away view in perspective of a collector box showing optional splitter and flow deflector only.

In a third embodiment, a replacement or addition for the lower partitions of FIGS. 5 or 6 is shown in FIG. 7. The flow guide shown in FIG. 7 has a splitter 90 adjacent the shaft housing, the leading edge of the splitter pointing to or into the tail cone 12 outlet. Two curved wings 91 extend from the splitter 90, the distance of the wings from the shaft housing preferably being less than the distance of the turbine outlet cone perimeter from the shaft housing. The wings may be attached to the collector box wall by struts or by any other suitable means. In addition, the splitter may be attached to the shaft housing. While FIG. 7 shows the splitter substantially at the cone outlet, the splitter may be moved forward into, or back away from, the outlet plane of the cone.

In operation, the wings 91 divide the flow from the bottom portion of the turbine outlet tail cone into two portions. The top portion, i.e., the portion closer to the shaft housing, is itself divided by the splitter so that it flows smoothly around the shaft housing. The bottom portion of the flow, i.e., the portion adjacent the collector box wall, partially migrates to the space between the outlet tail cone and the collector box wall behind the turbine outlet cone plane. This flow pattern reduces even further the number of stalls and flow reversals in the collector box. An optional gap (not shown) may be added between the wedge and the shaft housing to permit a small amount of exhaust flow along the shaft housing surface, thereby preventing the formation of thermal gradients along the shaft housing. If the splitter 90, wings 91, and/or backplate 92 are used with the lower ring, then the leading edges of the backplate 92, wings 91, and splitter 90 may connect to the lower ring. Optionally, gaps may be provided to allow for thermal expansion and to admit flow into the lower portion of the collector box.

After the final partition shape has been designed pursuant to the method described above, actual partitions may be built in the appropriate scale. High temperature steel is the preferable material for these partitions, although any other suitable material may be used.

Figure 9:
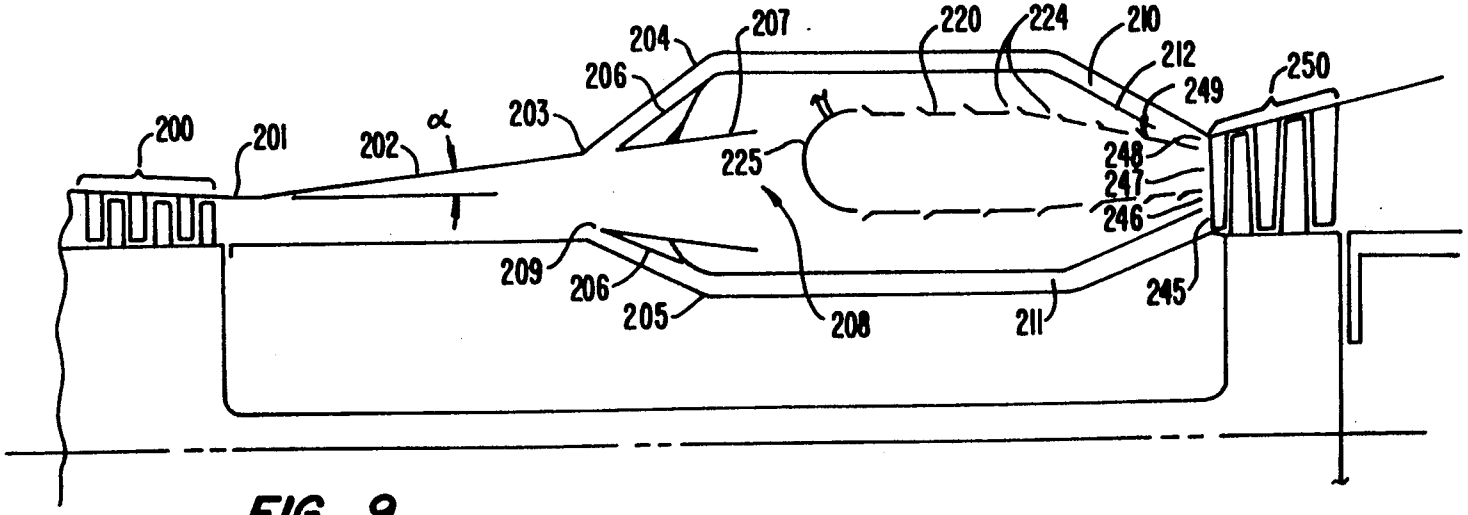
FIGS. 9 and 10 are a cross sections showing implementation of the process for a gas turbine compressor outlet and composition system.

FIG. 9 shows another alternative embodiment of the invention. FIG. 9 shows an alternative of the preferred embodiment is shown on an axial compressor expanding duct (diffuser) n of a jet engine or gas turbine.

The compressor 200 is adapted to primary diffuser inlet 201. The low pressure bypass passages 210 and 211 exit the expanding duct at exits 203 and 209, and lead to a lower pressure zones 248 and 245, respectively, where the passages rejoin. The exits 203 is shown flush with the wall; however, the nose of the exit can be recessed from the wall, in which case the flow capacity will be less but the flow drawn off will be more selected, favoring slowly moving wall boundary layer air.

Primary expanding duct exit 209 is shown with its downstream nose aggressively placed to intercept moving air, a more flow efficient and higher capacity arrangement.

The combuster 225 is conventionally placed. The diffuser extension 207 is adapted to primary diffuser 202 and to the receiving space 208.

Figure 10:
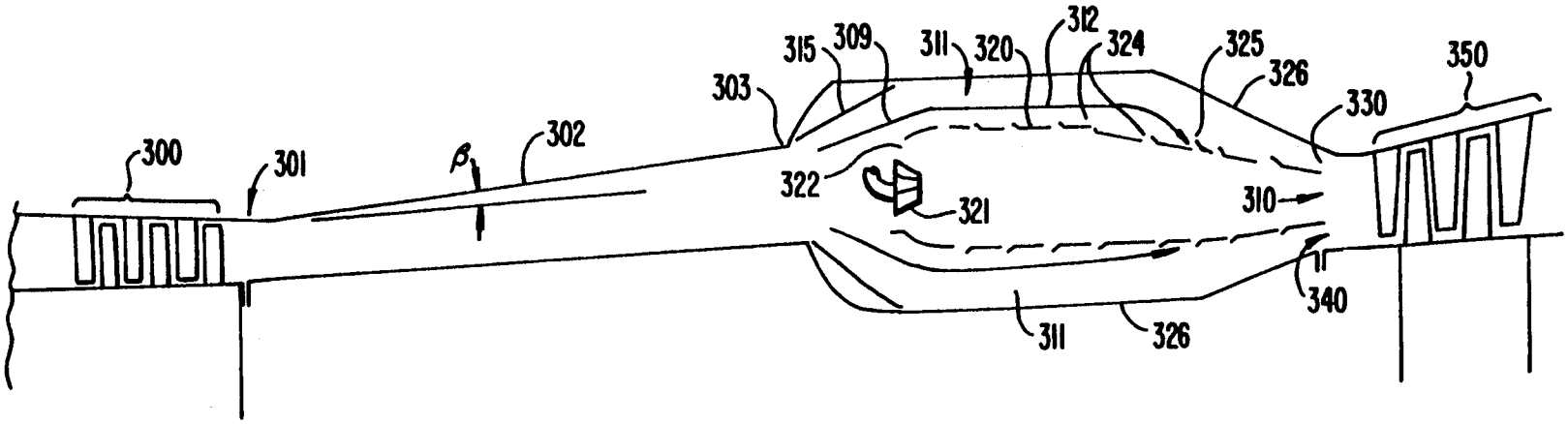

FIG. 10 shows an alternate arrangement of the diffuser expansion passages. Here, diffuser extension 309 extends downstream along side the combuster, the downstream end of diffuser extension 309 is adapted to combustor 320, possible leaving a small gap 325 to allow for thermal expansion, and supported as needed, such as to the receiver walls 326. The entrance to diffuser extension 309 is in line with primary diffuser outlet 303, but may be canted to allow the combuster 320 to be offset from the primary diffuser 302 axis. The flow entering secondary diffuser 309 at Optional fairing helps define the bypass passage 311. Both the high-energy flow leaving the combuster at 310 and the bypass flow passage outlet 330 and 340 join, the combined flows exit through the turbine 350.

The foregoing description and example calculations of the preferred embodiments of the invention have been presented for purposes of illustration and description. It is not intended to be exhaustive or to limit the invention to the precise form disclosed, and modifications and variations are possible in light of the above teaching. The embodiments selected and described in this description were selected to best explain the principles of the invention to enable others skilled in the art to best utilize the invention in various embodiments with various modifications as suited for the particular application contemplated. It is intended that the scope of the invention be defined by the claims appended hereto.

What is claimed is:

1. A flow enhancement system for turbine exhaust in the combination of:

a generally tubular sectioned turbine discharge duct having a forward smaller end for receiving gas flow from a turbine and a larger discharge end for discharging said gas received from said turbine;

a central turbine shaft housing disposed approximately concentrically on the central axis of said generally tubular turbine discharge duct extending through the discharge end of said duct;

a collector housing having a front, a rear, sides, and an bottom, therebetween, and a collector outlet overlying said bottom;

a collector inlet defined in said front about said discharge end of said turbine discharge duct whereby turbine exhaust discharged from said discharge duct enters said housing;

said collector outlet defined by said front, sides, and rear, said collector outlet requiring a turn in fluid flow from said collector inlet to outlet to permit the discharge of said turbine exhaust gas from said collector housing away from said shaft housing;

said rear of collector housing having said central turbine shaft housing connected thereto for permitting a central turbine shaft housing to pass outwardly of said housing for the extraction of power from a shaft;

the flow enhancement system within said collector housing for creating at least one low pressure zone downstream of said turbine discharge duct to vent any stall gas away from said turbine discharge duct and prevent stall formation comprising in combination:

a first flow deflector mounted adjacent said bottom of said collector housing;

said flow deflector extending at least partially around said central shaft housing and having an arcuate radial cross section with a first side of said deflector forming a concave side disposed to and toward the discharge end of said turbine discharge duct and a second convex surface disposed to said collector rear;

said flow deflector defining a gas dividing lip, said lip being non-circular with respect to said shaft housing for intersecting and dividing at varying radials around said turbine discharge duct gas flowing from said discharge end to distribute gas between said collector front and said collector rear on a varying area proportion as a function of angular position with respect to said central shaft housing with differing fractions of gas flowing adjacent the exterior surface of said turbine discharge duct being diverted to the concave portion of said flow deflector at varying radials whereby said diverted gas flows adjacent said concave wall of said deflector proximate to said front of said collector housing and out said collector outlet through to a low pressure zone;

said gas dividing lip further forming a central turbine exhaust flow path between the exterior of said turbine shaft housing and said flow deflector for permitting said turbine exhaust gas to pass over said flow deflector to and toward said rear of said collector housing whereby said gas flowing over said convex side of said flow deflector is diverted to said collector housing outlet along said rear of said housing.

2. The flow enhancement system of claim 1 and wherein said first flow deflector extends about 360°0 around said central shaft housing.

3. The flow enhancement system of claim 1 and wherein said first flow deflector extends about 180° about said central shaft housing, said deflector being positioned at said bottom of said collector housing on the opposite side of said central shaft housing from said collector outlet.

4. The flow enhancement system of claim 3 and further including:

a second flow deflector generally defined above said first flow deflector, said second flow deflector generally overlying said central shaft housing along an approximate 180° interval adjacent to said collector outlet;

said second flow deflector having an arcuate radial cross section with a first side of said deflector forming a concave side disposed to and toward the discharge end of said turbine discharge duct and a second convex surface disposed to said deflector;

said second flow deflector defining a gas dividing lip, said lip for intersecting and dividing at varying radials around and above said turbine discharge duct gas flowing from said discharge end to distribute gas between said collector front and said collector rear on a varying area proportion as a function of angular position with respect to said central shaft housing with differing fractions of gas flowing adjacent the exterior surface of said turbine discharge duct being diverted to the concave portion of said flow deflector at varying radials whereby said diverted gas flows adjacent said concave wall of said deflector proximate to said front of said collector housing and out said collector outlet through to a low pressure zone;

said gas dividing lip further forming a central turbine exhaust flow path between the exterior of said turbine shaft housing and conical flow deflector for permitting said turbine exhaust gas to pass over said flow deflector to and toward said rear of said collector housing whereby said gas flowing over said flow deflector is diverted to said collector housing outlet along said rear of said housing.

5. The flow enhancement system of claim 4 and wherein the upper end of said first deflector is position closer to said rear of said collector housing than said lower end of said second deflector to define a gas flow gap between said deflectors whereby gas discharged from said arcuate concave sides of said first deflector passes overlying the convex side of said second deflector and to said collector outlet.

6. The flow enhancement system of clam 5 and further including:

a flow dividing wedge at said arcuate wall of said collector housing remote from said collector discharge, said wedge positioned to divide flow between said central shaft housing and said turbine exhaust tube in first and second paths on either side of said wedge.

7. The flow enhancement of claim 6 and further including:

flashing connected to said wedge for diverting gas outwardly of said wedge generally along said bottom of said collector housing.

8. The flow enhancement system of claim 1 and wherein said generally tubular sectioned turbine discharge duct is a circular cone.

9. The flow enhancement system of claim 1 and wherein said gas dividing lip has an elliptical profile with respect to said shaft housing with the major axis of said ellipse being horizontal and the minor axis of said ellipse being vertical.

10. A flow enhancement system for turbine exhaust in the combination of:

a generally tubular sectioned turbine discharge duct having a smaller forward end for receiving gas flow from a turbine and a larger discharge end for discharging said gas received from said turbine;

a central turbine shaft housing disposed approximately concentrically on the central axis of said generally tubular turbine discharge duct extending through the discharge end of said duct;

a collector housing having a front, side, rear, and a bottom therebetween, and a collector outlet overlying said bottom;

a collector inlet defined in said front about said discharge end of said turbine discharge duct whereby turbine exhaust discharged from said discharge duct enters sad housing;

said collector outlet defined by said front; side; and rear; said collector outlet requiring a substantially 90° turn in fluid flow from said collector inlet to outlet to permit the discharge of said turbine exhaust gas from said collector housing away from said shaft housing;

said rear of said collector housing having said central turbine shaft housing connected thereto for permitting a central turbine shaft to pass outwardly of said housing for the extraction of power from a shaft;

the flow enhancement system within said collector housing for creating at least one low pressure zone downstream of said turbine discharge duct to vent any stall gas away from said turbine discharge duct and prevent stall formation comprising in combination:

a first flow deflector mounted adjacent said bottom of said collector housing;

said flow deflector extending at least partially around said central shaft housing and having an arcuate radial cross section with a first side of said deflector forming a concave side disposed to and toward the discharge end of said turbine discharge duct and a second convex surface disposed to said collector rear;

said first flow deflector defining a gas dividing lip. said lip being non-circular with respect to said shaft housing for intersecting and dividing at varying radials around said turbine discharge duct gas flowing from said discharge end to distribute gas between said collector front and said collector rear on a varying area proportion as a function of angular position with respect to said central shaft housing with differing fractions of gas flowing adjacent the exterior surface of said turbine discharge duct being diverted to the concave portion of said flow deflector at varying radials whereby said diverted gas flows adjacent said concave wall of said deflector proximate to said front of said collector housing and out said collector outlet through to a low pressure zone;

said gas dividing lip further forming a central turbine exhaust flow path between the exterior of said turbine shaft housing and flow deflector for permitting said turbine exhaust gas to pass over said flow deflector to and toward said rear of said collector housing whereby said gas flowing over said flow deflector is diverted to said collector housing outlet along said rear of said housing;

said first deflector being positioned at said bottom of said collector housing on the opposite side of said central shaft housing from said collector outlet;

a second flow deflector generally defined above said first flow deflector, said second flow deflector generally overlying said central shaft housing along an interval adjacent to said collector outlet;

said second flow deflector having an arcuate radial cross section with a first side of said deflector forming a concave side disposed to and toward the discharge end of said turbine discharge duct and a second convex surface disposed to said deflector;

said second flow deflector defining a gas dividing lip, said lip being non-circular with respect to said shaft housing for intersecting and dividing at varying radials around said turbine discharge duct gas flowing from said discharge end to distribute gas between said collector front and said collector rear on a varying area proportion as a function of angular position with respect to said central shaft housing with differing fractions of gas flowing adjacent the exterior surface of said turbine discharge duct being diverted to the concave portion of said flow deflector at varying radials whereby said diverted gas flows adjacent said concave wall of said deflector proximate to said front of said collector housing and out said collector outlet through to a low pressure zone;

said gas dividing lip further forming a central turbine exhaust flow path between the exterior of said turbine shaft housing and flow deflector for permitting said turbine exhaust gas to pass over said convex side of said flow deflector to and toward said rear of said collector housing whereby said gas flowing over said convex side of said flow deflector is diverted to said collector housing outlet along said rear of said housing.

11. The flow enhancement system of claim 10 and wherein the upper end of said first deflector is positioned closer to said rear of said collector housing than said lower end of sad second deflector to define a gas flow gap between said deflectors whereby gas discharged from said arcuate concave sides of said first deflector passes overlying the convex side of said second deflector.

12. The flow enhancement system of claim 10 and further including:

a flow dividing wedge at said bottom of said collector housing remote from said collector discharge, said wedge positioned to divide flow between said central shaft housing and said turbine exhaust tube in first and second paths on either side of said wedge.

13. The flow enhancement system of claim 12 and further including:

flashing connected to said wedge for diverting gas outwardly of said wedge generally along said bottom of said collector housing.

14. The flow enhancement system of claim 10 and wherein said generally tubular sectioned turbine discharge duct is a circular cone.

15. The flow enhancement system of claim 10 and including:

air foil shaped struts extending across said collector adjacent said discharge.

16. The flow enhancement system of claim 10 and wherein sad gas dividing lips of said first and second deflectors each have an elliptical profile with respect to said shaft housing with the major axis of said ellipses being horizontal and the minor axis of said ellipses being vertical.

* * * * *